US010386079B2

(12) United States Patent
Kim et al.

(10) Patent No.: US 10,386,079 B2
(45) Date of Patent: Aug. 20, 2019

(54) AIR CONDITIONER

(71) Applicant: Samsung Electronics Co., Ltd., Suwon-si (KR)

(72) Inventors: Byung Ghun Kim, Suwon-si (KR); Woo Seog Song, Yongin-si (KR); Hyun-Ho Kim, Suwon-si (KR); Hong Yeol Moon, Hwaseong-si (KR); Chul Byung Park, Ansan-si (KR); Seung-Jun Yoon, Suwon-si (KR); Eun Sung Jo, Seoul (KR); Jei Min Choi, Suwon-si (KR); Hyeong Joon Seo, Suwon-si (KR); Jun Hwa Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/813,406

(22) Filed: Nov. 15, 2017

(65) Prior Publication Data

US 2018/0135871 A1 May 17, 2018

(30) Foreign Application Priority Data

Nov. 16, 2016 (KR) ..... 10-2016-0152621

(51) Int. Cl.
*F24F 11/79* (2018.01)
*F24F 13/08* (2006.01)
(Continued)

(52) U.S. Cl.
CPC ..... *F24F 1/0033* (2013.01); *F24F 11/79* (2018.01); *F24F 13/08* (2013.01); *F24F 13/15* (2013.01);
(Continued)

(58) Field of Classification Search
CPC ..... F24F 1/0033; F24F 11/79; F24F 13/08; F24F 13/20; F24F 1/0025; F24F 1/0022
See application file for complete search history.

(56) References Cited

U.S. PATENT DOCUMENTS 2,275,295 A * 3/1942 Greenway ..... F24F 1/0007 62/285
4,361,525 A * 11/1982 Leyland ..... F24F 6/04 165/60
(Continued)

FOREIGN PATENT DOCUMENTS

JP 10-253100 9/1998
JP 2003-4261 1/2003
(Continued)

OTHER PUBLICATIONS

International Search Report dated Feb. 26, 2018 in International Patent Application No. PCT/KR2017/013030.

*Primary Examiner* — Kun Kai Ma
(74) *Attorney, Agent, or Firm* — Staas & Halsey LLP

(57) ABSTRACT

An air conditioner includes a housing provided with a suction port and a discharge port elongated in one direction on the lateral side of the suction port, a main flow path configured to connect the suction port to the discharge port, a main fan provided in the main flow path to suck air via the suction port and to discharge the air via the discharge port, an auxiliary fan configured to suck the air around the discharge port to regulate the direction of the air which is discharged via the discharge port and an auxiliary flow path configured to guide the air sucked by the auxiliary fan. According to the air conditioner, it is possible to control the direction of the discharge airflow without a blade structure, increase the discharge amount, reduce the flow noise, and differentiate the design.

20 Claims, 13 Drawing Sheets

(51) Int. Cl.

| | |
|---|---|
| ***F24F 13/15*** | (2006.01) |
| ***F24F 13/20*** | (2006.01) |
| ***F24F 13/22*** | (2006.01) |
| ***F24F 1/0022*** | (2019.01) |
| ***F24F 1/0025*** | (2019.01) |
| ***F24F 1/0033*** | (2019.01) |

(52) U.S. Cl.
CPC ..... *F24F 13/20* (2013.01); *F24F 1/0022* (2013.01); *F24F 1/0025* (2013.01); *F24F 13/222* (2013.01)

(56) References Cited

U.S. PATENT DOCUMENTS 4,526,227 A * 7/1985 Baker ..... F24F 1/0007 165/124
4,958,500 A * 9/1990 Kuroda ..... F24F 1/0033 62/263
5,335,721 A * 8/1994 Wollaber ..... F24F 1/027 165/122
5,372,189 A * 12/1994 Tsunekawa ..... F24F 1/027 165/59
5,660,586 A * 8/1997 Chiu ..... F04D 25/10 454/200
7,266,971 B2 * 9/2007 Kang ..... F24F 1/0007 62/317
2007/0137243 A1 * 6/2007 Lee ..... F04D 29/462 62/419
2007/0140831 A1 * 6/2007 Pong ..... F04D 17/04 415/52.1
2011/0039490 A1 * 2/2011 Wiese ..... F24F 7/013 454/200
2011/0113801 A1 * 5/2011 Rajasekaran ..... B64F 1/364 62/186
2011/0253350 A1 * 10/2011 Belles ..... F24D 19/0087 165/120
2014/0360805 A1 * 12/2014 Berkman ..... H04R 1/02 181/141
2015/0022996 A1 * 1/2015 Kang ..... F21V 33/0092 362/23.14
2015/0258488 A1 * 9/2015 Meirav ..... F24F 3/0442 95/115
2015/0345809 A1 * 12/2015 Hayashi ..... F24F 13/20 165/121
2015/0354850 A1 * 12/2015 Iwano ..... F24F 13/15 454/256
2016/0327297 A1 * 11/2016 Song ..... F24F 1/0033
2017/0115028 A1 * 4/2017 Lee ..... B01D 46/0005
2018/0340699 A1 * 11/2018 Kim ..... F24F 11/79

FOREIGN PATENT DOCUMENTS

| | | |
|---|---|---|
| JP | 2012-17941 | 1/2012 |
| KR | 10-2000-0055145 | 9/2000 |
| KR | 10-2016-0091290 | 8/2016 |

* cited by examiner

AIR CONDITIONER

CROSS-REFERENCE TO RELATED APPLICATIONS

This application claims the priority benefit of Korean Patent Application No. 10-2016-0152621, filed on Nov. 16, 2016 in the Korean Intellectual Property Office, the disclosure of which is incorporated herein by reference.

BACKGROUND

1. Field

The following description relates to an air conditioner capable of controlling the discharge air flow without a blade structure.

2. Description of the Related Art

An air conditioner is an apparatus provided with a compressor, a condenser, an expansion valve, an evaporator, and a blowing fan for controlling the indoor temperature, the humidity, and the air flow by using the refrigeration cycle. The air conditioner is classified into a separated type provided with an indoor portion disposed in indoors and an outdoor portion disposed outdoors, and an integral type in which both of the indoor portion and the outdoor portion are disposed in a single housing.

The indoor portion of the air conditioner is provided with a heat exchanger exchanging the heat between the refrigerant and the air, a blowing fan blowing the air, and a motor driving the blowing fan, thereby cooling or heating the room.

The indoor portion of the air conditioner may be provided with a direction control device to discharge the air, which is cooled or heated by the heat exchanger, to various directions. In general, the direction control device is provided with a vertical or horizontal blade installed in a discharge port, and a driver rotating the blade. That is, the indoor portion of the air conditioner regulates the direction of the discharge air flow by adjusting the rotational angle of the blade.

As for the direction control structure using the blade, because the air flow is prevented by the blade, the amount of the discharged air may be reduced and the flow noise may be increased due to the turbulence generated around the blade. In addition, the rotation axis of the blade is formed a linear shape and thus the shape of the discharging port is limited to the linear shape.

SUMMARY

Therefore, it is an aspect of the present disclosure to provide an indoor portion of an air conditioner capable of controlling the discharge air flow without a blade structure.

Additional aspects of the present disclosure will be set forth in part in the description which follows and, in part, will be obvious from the description, or may be learned by practice of the present disclosure.

In accordance with one aspect of the present invention, an air conditioner includes a housing provided with a suction port and a discharge port elongated in one direction on the lateral side of the suction port; a main flow path configured to connect the suction port to the discharge port; a main fan provided in the main flow path to suck air via the suction port and to discharge the air via the discharge port, and provided with a rotation axis disposed in parallel to a longitudinal direction of the discharge port; an auxiliary fan configured to suck the air around the discharge port to regulate the direction of the air, which is discharged via the discharge port; and an auxiliary flow path configured to guide the air sucked by the auxiliary fan.

The auxiliary flow path may be formed in parallel to the longitudinal direction of the discharge port.

The auxiliary flow path may include a discharge flow path discharging the air and a suction flow path sucking the air to guide the air to the discharge flow path.

The discharge flow path may be provided in the central portion of the longitudinal direction of the auxiliary flow path, and the suction flow path may be provided on both sides of the discharge flow path.

The air conditioner may further include a fan case accommodating the auxiliary fan, and the discharge flow path may be formed in the inside of the fan case and the suction flow path is formed in the outside of the fan case.

A cross-sectional area of the suction flow path may be reduced or the same as being away from the auxiliary fan.

The housing may include an inlet sucking the air to the suction flow path, and an outlet discharging the air from the discharge flow path.

The size of the inlet may be reduced or the same as being away from the auxiliary fan.

The auxiliary fan may include a plurality of auxiliary fans, and the discharge flow path may include a plurality of discharge flow paths to correspond to the plurality of auxiliary fans.

The main fan may be a cross-flow fan.

The auxiliary fan may be a centrifugal fan.

The air conditioner may further include a heat exchanger disposed to be inclined on the lateral side of the main fan.

The air conditioner may further include a drain pan configured to collect condensed water generated by the heat exchanger.

The air conditioner may further include an auxiliary drain provided between the heat exchanger and the suction port to guide the condensed water generated by the heat exchanger.

In accordance with an aspect of the present invention, an air conditioner includes an upper housing provided to be embedded in or hold on a ceiling and provided with a main flow path and an auxiliary flow path separated from the main flow path; a lower housing coupled to a lower portion of the upper housing and provided with a suction port and a discharge port; a main fan configured to suck the air to the main flow path via the suction port and configured to discharge the air from the main flow path via the discharge port; and an auxiliary fan configured to suck the air around the discharge port to the auxiliary flow path to regulate the direction of the air, which is discharged via the discharge port.

The upper housing may include a partition wall partitioning into the main flow path and the auxiliary flow path.

The upper housing may include an auxiliary fan mounting portion to which the auxiliary fan is mounted.

In accordance with an aspect of the present invention, an air conditioner includes a housing provided with a suction port and a discharge port; a main fan configured to suck the air to the inside of the housing via the suction port and configured to discharge the air from the inside of the housing via the discharge port; an auxiliary fan configured to suck the air around the discharge port to regulate the discharge air flow, which is discharged via the discharge port, to the vertical direction; and a plurality of blades configured to regulate the discharge air flow, which is discharged via the discharge port, to the left and right direction.

The plurality of blades may be rotatable between a horizontal position and a vertical position.

The plurality of blades may close the discharge port when the plurality of blades is in the horizontal position.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
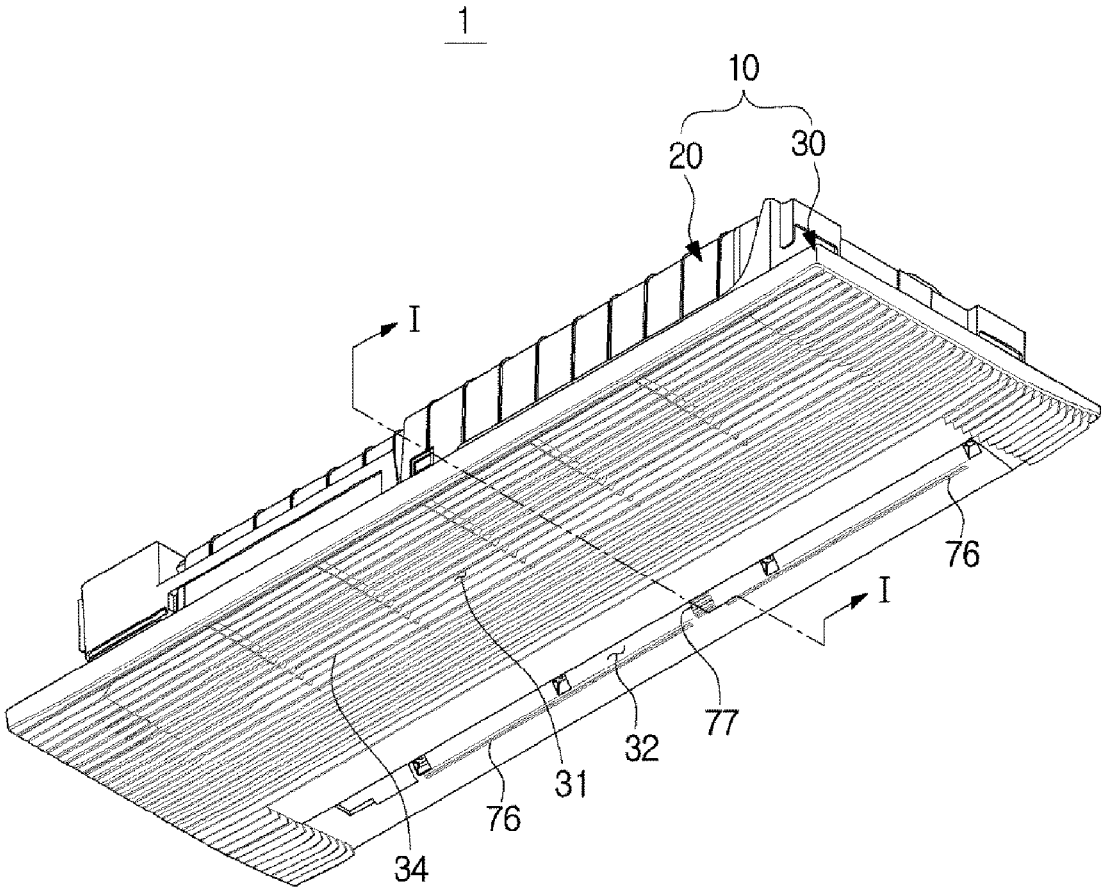
FIG. 1 is a bottom perspective view illustrating an air conditioner according to an embodiment.

Embodiments described in the present disclosure and configurations shown in the drawings are merely examples of the embodiments of the present disclosure, and may be modified in various different ways at the time of filing of the present application to replace the embodiments and drawings of the present disclosure.

Hereinafter embodiments of the present disclosure will be described with reference to the drawings.

Figure 2:
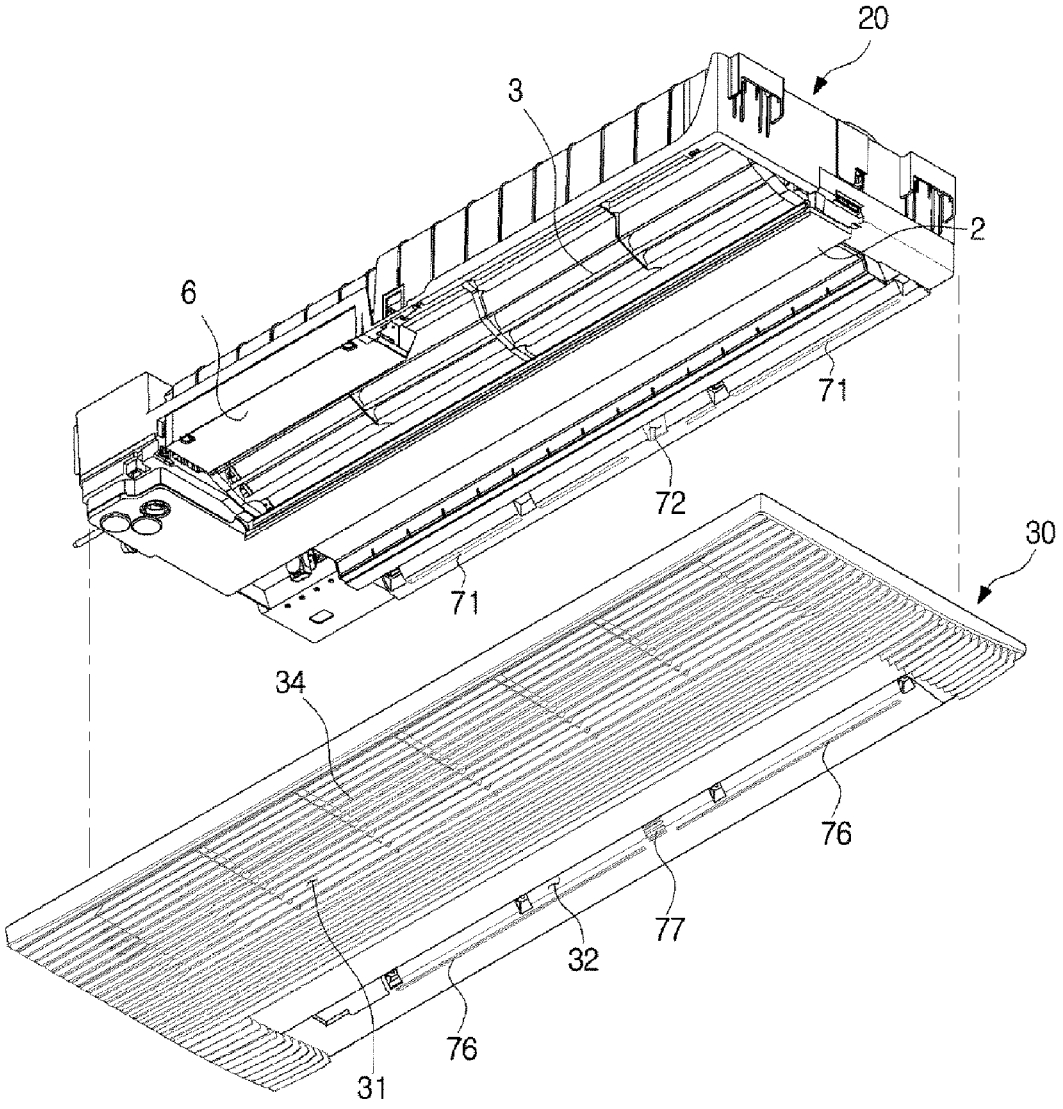
FIG. 2 is a view illustrating a case a lower housing is separated from the air conditioner of FIG. 1.
Figure 3:
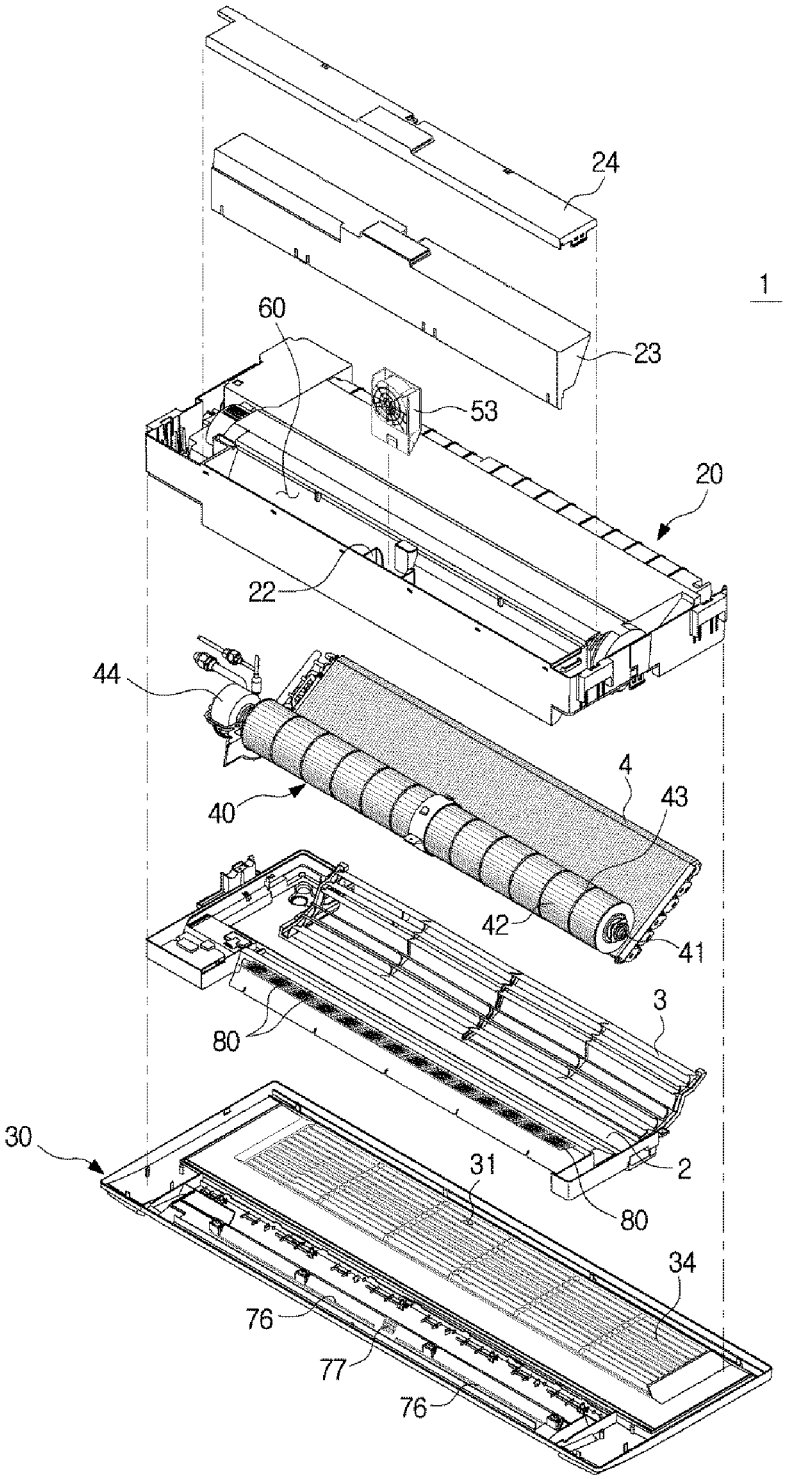
FIG. 3 is an exploded view illustrating a main configuration of the air conditioner of FIG. 1.
Figure 4:
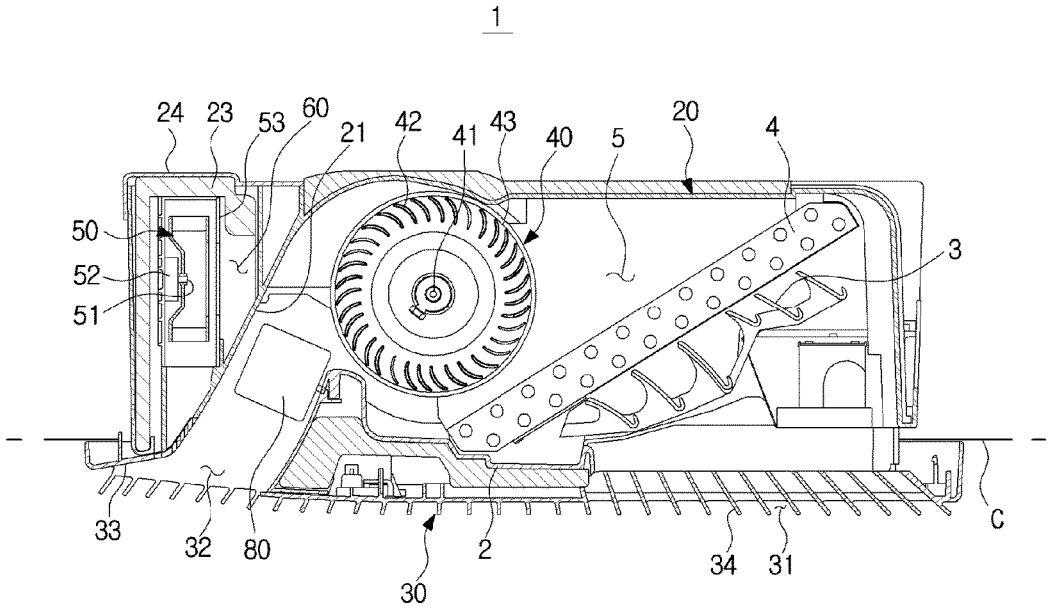
FIG. 4 is a cross-sectional view taken along I-I of FIG. 1.
Figure 5:
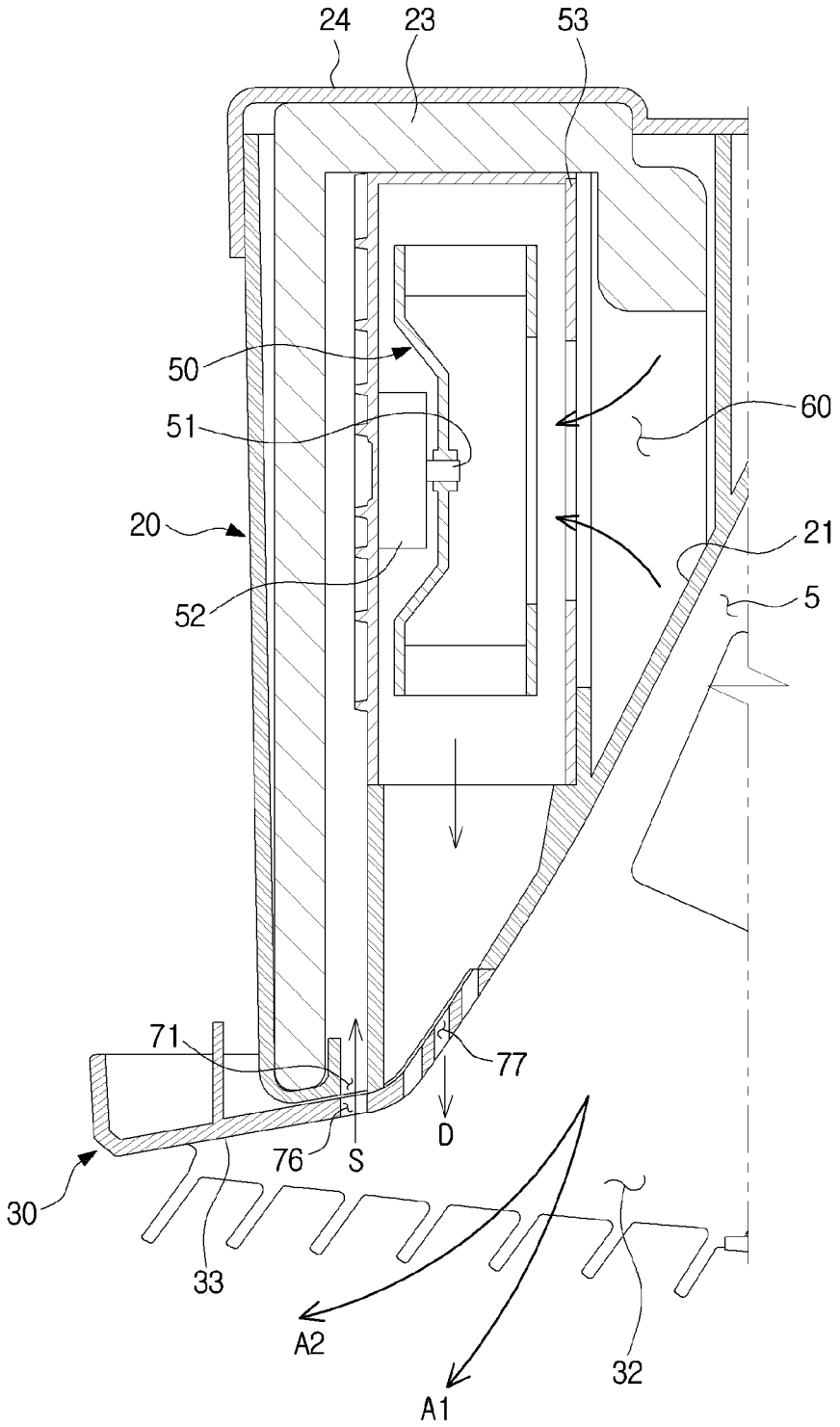
FIG. 5 is an enlarged view illustrating a part of the left side of FIG. 4.
Figure 6:
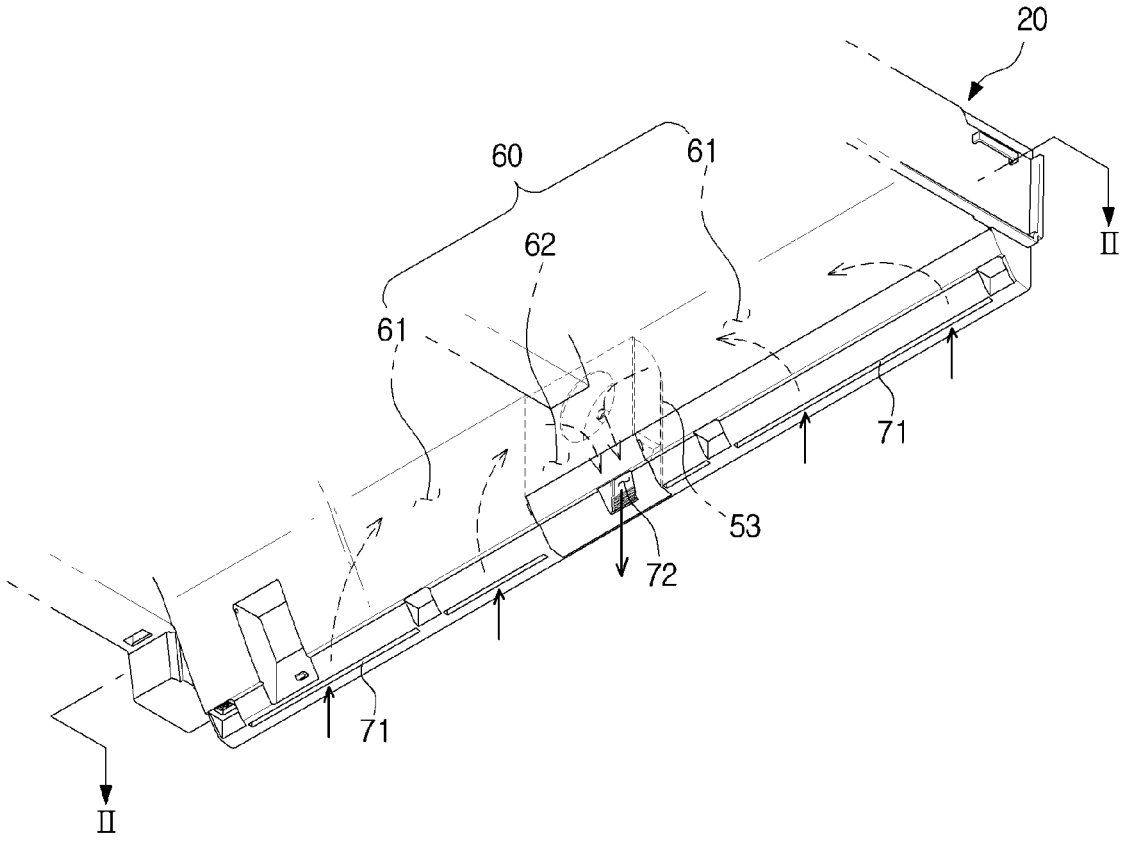
FIG. 6 is an enlarged bottom perspective view illustrating the upper housing of the air conditioner.
Figure 7:
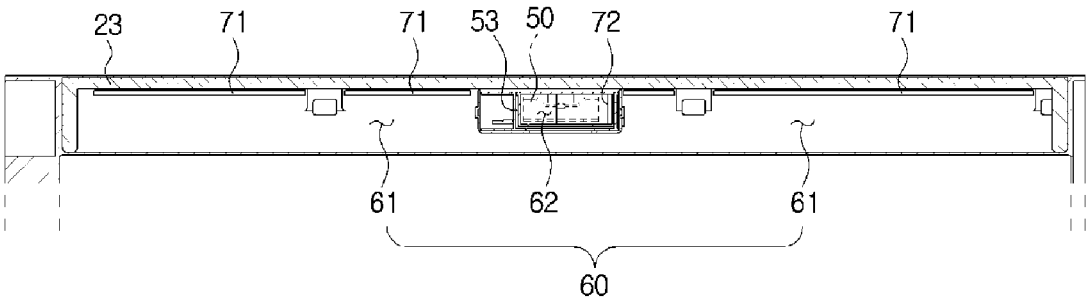
FIG. 7 is a cross-sectional view taken along II-II of FIG. 6.
Figure 8:
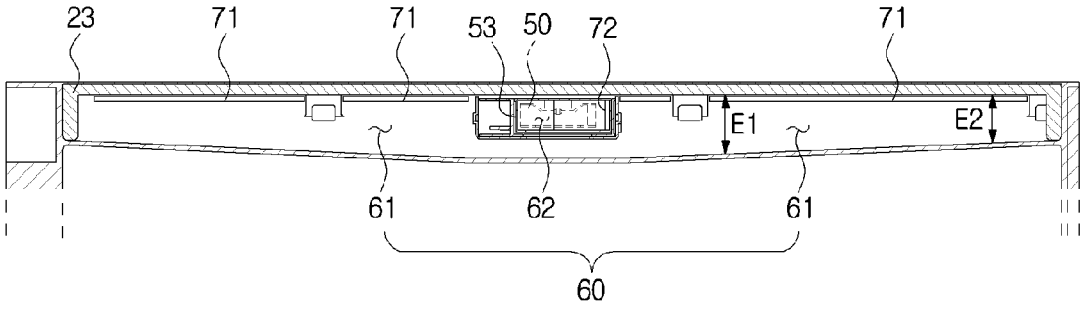
FIG. 8 is a view illustrating an air conditioner according to an embodiment.
Figure 9:
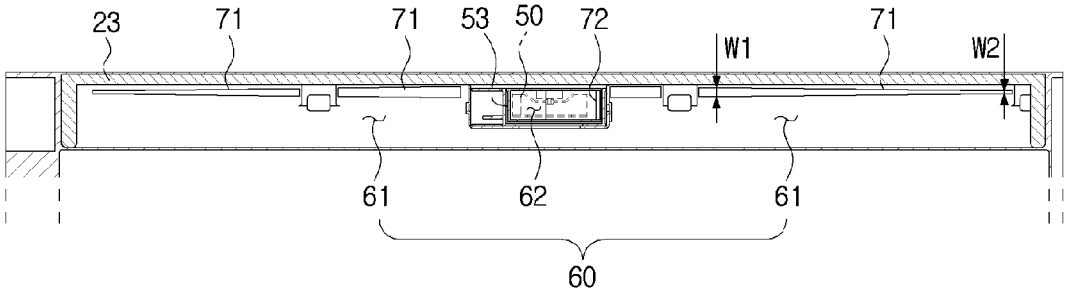
FIG. 9 is a view illustrating an air conditioner according to an embodiment.
Figure 10:
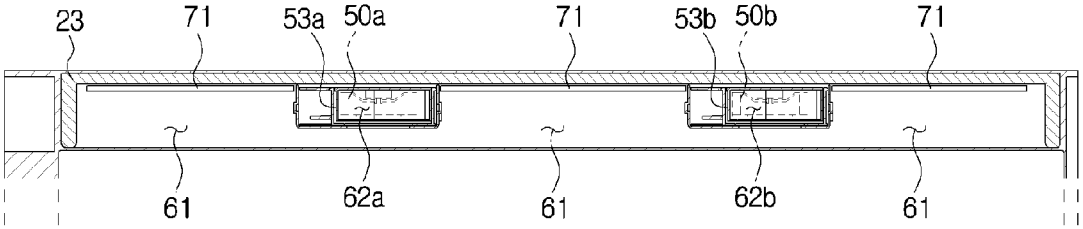
FIG. 10 is a view illustrating an air conditioner according to an embodiment.

FIG. 1 is a bottom perspective view illustrating an air conditioner according to an embodiment. FIG. 2 is a view illustrating a case a lower housing is separated from the air conditioner of FIG. 1. FIG. 3 is an exploded view illustrating a main configuration of the air conditioner of FIG. 1. FIG. 4 is a cross-sectional view taken along I-I of FIG. 1. FIG. 5 is an enlarged view illustrating a part of the left side of FIG. 4. FIG. 6 is an enlarged bottom perspective view illustrating the upper housing of the air conditioner. FIG. 7 is a cross-sectional view taken along II-II of FIG. 6. FIG. 8 is a view illustrating an air conditioner according to an embodiment. FIG. 9 is a view illustrating an air conditioner according to an embodiment. FIG. 10 is a view illustrating an air conditioner according to an embodiment.

An air conditioner will be described according to embodiments with reference to FIGS. 1 to 10.

An air conditioner 1 may be embedded in or on a ceiling (C). The air conditioner 1 may include a housing 10 provided with an suction port 31 and a discharge port 32, a main flow path 5 connecting the suction port 31 to the discharge port 32, and a main fan 40 provided in the main flow path 5 to suck air via the suction port 31 and then discharge the air via the discharge port 32.

The suction port 31 may be formed on one side of the lower portion of the housing 10 and the discharge port 32 may be formed on the lateral side of the suction port 31. The discharge port 32 may be elongated in one direction. The housing 10 may have a substantially rectangular shape when viewed in the vertical direction.

Particularly, the housing 10 may include an upper housing 20, which is embedded in or attached to the ceiling (C), and a lower housing 30 coupled to the lower portion of the upper housing 20.

The lower housing 30 may be formed in an approximately plate shape, and a suction port 31 and discharge port 32 may be formed in the lower housing 30. In the lower housing 30, a grill 34 filtering the dust contained in the air sucked via the suction port 31 may be provided.

The upper housing 20 may be formed in an approximately box shape having an opened lower surface. In the inside of the upper housing 20, the main path 5 connecting the suction port 31 to the discharge port 32 may be formed.

The main fan 40 may be a cross-flow fan. The conventional axial-flow fan may flow the air in the direction parallel to the axis, but the cross-flow fan may flow the air in the direction perpendicular to the axis. The cross flow fan 40 may include a rotation axis 41, a plurality of blades 42 arranged in a circumferential direction with respect to the rotation axis 41, and a supporting plate 43 supporting the blades 42. The main fan 40 may be disposed such that the rotation axis 41 is in parallel to the longitudinal direction of the discharge port 32.

A heat exchanger 4 for heat-exchanging heat with air to cool the air may be provided on the lateral side of the upstream side of the main fan 40. The heat exchanger 4 may be inclined with respect to the horizontal plane to be perpendicular to the air flow flowing in the main flow path 5. The main fan 40 may receive the driving force from a main fan motor 44.

In the lower side of the heat exchanger 4, a drain pan 2 may be provided to collect condensed water generated by the heat exchanger 4. The water collected in the drain pan 2 may be discharged to the outside of the air conditioner 1 by using the pump.

Between the heat exchanger 4 and the suction port 31, an auxiliary drain 3 may be provided to firstly collect the condensed water, which is dropped from the heat exchanger 4, and guide the condensed water to the drain pan 2. A control box 6 driving the air conditioner 1 may be provided between the auxiliary drain 3 and the suction port 31.

With this configuration, when the main fan 40 rotates, the air may be sucked into the main flow path 5 through the suction port 31. The air sucked into the main flow path 5 may be cooled through the heat exchanger 4 and then discharged from the main flow path 5 through the discharge port 32.

The air conditioner 1 may include an auxiliary fan 50 sucking the air around the discharge port 32 to adjust the direction of the air discharged through the discharge port 32. The auxiliary fan 50 may adjust the vertical direction of the air discharged through the discharge port 32. The air conditioner 1 may include an auxiliary flow path 60 provided to guide the air sucked by the auxiliary fan 50.

As illustrated in FIG. 5, when the auxiliary fan 50 rotates and sucks the air around the discharge port 32 to the S direction, the direction of the air discharged from the discharge port 32 may be changed from the A1 direction to the A2 direction. That is, when the auxiliary fan 50 rotates and sucks the air around the discharge port 32 to the S direction, the direction of the air discharged from the discharge port 32 may be changed from the vertical direction to the horizontal direction. The lower housing 30 may be provided with a Coanda surface 33 allowing the air to flow tightly to the Coanda surface 33 due to the Coanda effect. The air, which is sucked around the discharge port 32 to the auxiliary flow path 60, may be discharged from the auxiliary flow path 60 to the main flow path 5 in the D direction, again.

The auxiliary flow path 60 may be formed by the upper housing 20. The upper housing 20 may have a partition wall 21 partitioning the main flow path 5 and the auxiliary flow path 60. The upper housing 20 may be provided with a heat insulating material 23 insulating the auxiliary flow path 60 and a cover 24 opening and closing an open side of the auxiliary flow path 60. The upper housing 20 may be provided with an auxiliary fan mounting portion 22 to mount the auxiliary fan 50 to the auxiliary flow path 60.

The auxiliary flow path 60 may be formed substantially in parallel to the longitudinal direction of the discharge port 32. The auxiliary flow path 60 may include a discharge flow path 62 discharging the air, and a suction flow path 61 sucking the air to guide the air to the discharge flow path 62. The discharge flow path 62 may be provided at a central portion in the longitudinal direction of the auxiliary flow path 60 and the suction flow path 61 may be provided at both sides of the discharge flow path 62.

The auxiliary fan 50 may be disposed in the discharge flow path 62. The auxiliary fan 50 may be a centrifugal fan that sucks air in the direction of a rotation axis 51 and discharges the air in the radial direction. The auxiliary fan 50 may receive the driving force from the auxiliary fan motor 52. The auxiliary fan 50 may be mounted in the inside of a fan case 53 and the auxiliary flow path 60 may be divided into the suction flow path 61 and the discharge flow path 62 by the fan case 53. That is, in the inside of the fan case 53, the discharge flow path 62 may be formed and in the outside of the fan case 53, the suction flow path 61 may be formed.

The housing 10 may be provided with inlets 71 and 76 sucking the air into the suction flow path 61 and outlets 72 and 77 discharging the air from the discharge flow path 62. Particularly, the upper housing 20 may be provided with the inlet 71 and the outlet 72 and the lower housing 30 may be provided with the inlet 76 and the outlet 77.

The inlet 71 of the upper housing 20 and the inlet 76 of the lower housing 30 may be formed adjacent to each other at positions corresponding to each other so that the air is sucked into the suction flow path 61 through the inlet 76 and the inlet 71.

The outlet 72 of the upper housing 20 and the outlet 77 of the lower housing 30 may be formed adjacent to each other at positions corresponding to each other so that the air is discharged into the discharge flow path 62 through the outlet 72 and the outlet 77.

As illustrated in FIG. 8, a cross-sectional area of the suction flow path 61 may be reduced or may have the same size as being away from the auxiliary fan 50. That is, a cross-sectional area (E2) of the suction flow path 61 that is relatively far from the auxiliary fan 50 may be smaller than or equal to a cross-sectional area (E1) of the suction flow path 61 that is relatively close to the auxiliary fan 50. The reason why the cross sectional area of the suction flow path 61 is reduced or maintained to be the same as being away from the auxiliary fan 50, is to suck the air uniformly by compensating the suction force according to the distance, because the suction force is reduced as a distance from the auxiliary fan 50 increases.

According to the same manner, as illustrated in FIG. 9, the size of the inlet 71 may be reduced or the same as being away from the auxiliary fan 50. That is, the size (W2) of the inlet 71 that is relatively far from the auxiliary fan 50 may be smaller than or the same as the size (W1) of the inlet 71 that is relatively close to the auxiliary fan 50. Also, the inlet 76 may be reduced or the same as being away from the auxiliary fan 50, in the same manner as the inlet 71.

As illustrated in FIG. 10, a plurality of fans 50*a* and 50*b* may be provided. In the auxiliary flow path 60, a plurality of fan cases 53*a* and 53*b* in which the plurality of fans 50*a* and 50*b* are provided and a plurality of discharge flow path 62*a* and 62*b* may be formed.

By using the above mentioned configuration, instead of the conventional blade, the auxiliary fan 50 may be used to regulate the vertical direction of the air discharged via the discharge port 32. Therefore, regardless of the direction of the discharge air flow, it may be possible to maintain the amount of discharge air and to reduce the air flow noise. In addition, it may be possible to change the shape of the discharge port.

Figure 11:
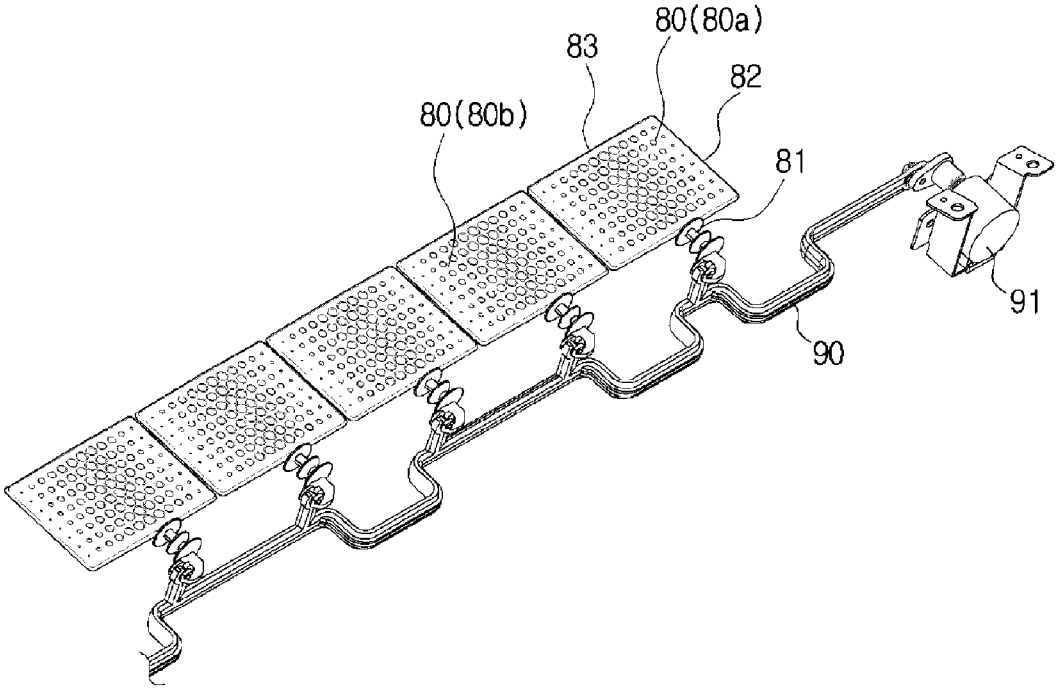
FIG. 11 is a view illustrating left and right direction adjustment blades of the air conditioner of FIG. 1.
Figure 12:
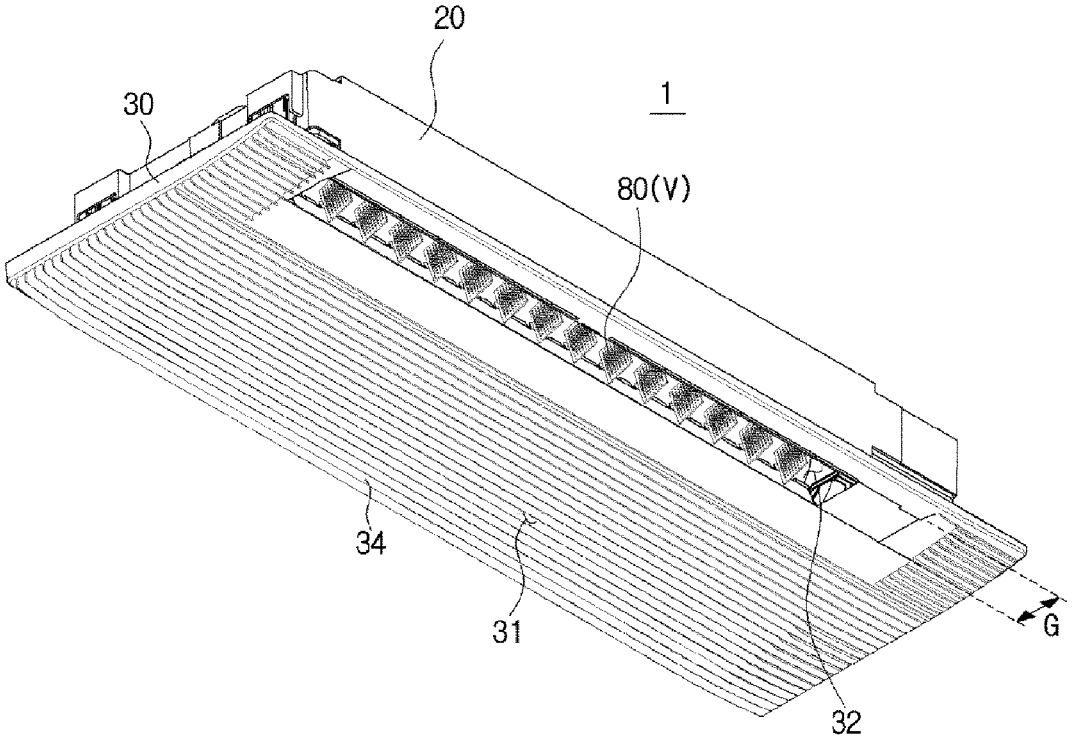
FIG. 12 is a view illustrating the left and right direction adjustment blades of the air conditioner of FIG. 1 rotated to a vertical position.
Figure 13:
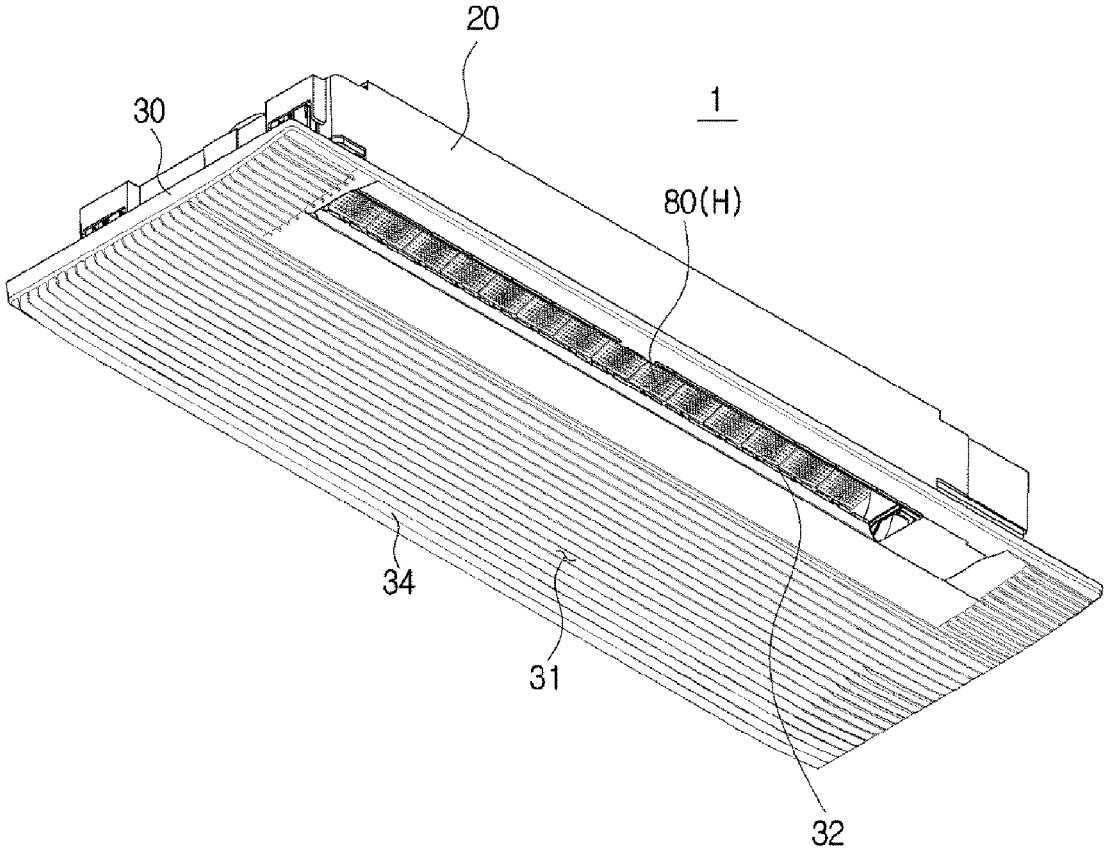
FIG. 13 is a view illustrating the left and right direction adjustment blades of the air conditioner of FIG. 1 rotated to a horizontal position to close the discharge port.

FIG. 11 is a view illustrating left and right direction adjustment blades of the air conditioner of FIG. 1. FIG. 12 is a view illustrating the left and right direction adjustment blades of the air conditioner of FIG. 1 rotated to a vertical position. FIG. 13 is a view illustrating the left and right direction adjustment blades of the air conditioner of FIG. 1 rotated to a horizontal position to close the discharge port.

Referring to FIGS. 11 to 13, the air conditioner 1 may include a device configured to adjust the discharge air flow in the left and right direction as well as the above mentioned device configured to adjust the discharge air flow in the vertical direction. The air conditioner 1 may be provided with a plurality of blades 80 provided to be rotatable to adjust the left and right direction of the air discharged via the discharge port 32.

The blade 80 may be disposed on the downstream side of the main flow path 5. The blade 80 may be rotatable between the vertical position (V) and horizontal position (H) with respect to a rotation axis 81 perpendicular to the longitudinal direction of the discharge port 32. The blade 80 may rotate between the vertical position (V) and the horizontal position (H) to adjust the left and right direction of the air discharged through the discharge port 32.

The driving force generated by a blade driving motor 91 may be transmitted to the plurality of blades 80 through a lever 90 so that the plurality of blades 80 may be rotated.

Further, the plurality of blades 80 may open and close the discharge port 32. When the plurality of the blades 80 is in the horizontal position (H), the plurality of blades 80 may substantially close the discharge port 32.

For this, the blade 80 may be formed in a rectangular shape having a plurality of first sides 83 in parallel to the longitudinal direction of the discharge port 32 and a plurality of second sides 82 in parallel to the direction of the width (G) of the discharge port 32. The second side 82 of the blade 80 may have a length substantially equal to the width (G) of the corresponding discharge port 32.

A blade 80*a* and a blade 80*b* adjacent to each other may be provided such that a gap between the blade 80*a* and the blade 80*b* is substantially closed when the blade 80*a* and the blade 80*b* are disposed in the horizontal position.

As is apparent from the above description, according to the proposed indoor portion of the air conditioner, it is possible to regulate the direction of the discharge air flow by sucking the air around the discharge port.

It is possible to maintain the constant flow rate when regulating the direction of discharge air flow.

It is possible to reduce the flow noise.

It is possible for the shape of the discharge port to have various shapes, e.g., a circular shape and a curved shape instead of the conventional linear shape.

Although a few embodiments of the present disclosure have been shown and described, it would be appreciated by those skilled in the art that changes may be made in these embodiments without departing from the principles and spirit of the disclosure, the scope of which is defined in the claims and their equivalents.

| Description of symbols | |
|---|---|
| 1: air conditioner | 5: main flow path |
| 10: housing | 20: upper housing |
| 21: partition wall | 30: lower housing |
| 31: suction port | 32: discharging port |
| 40: main fan | 50: auxiliary fan |
| 60: auxiliary flow path | 71: upper housing inlet |
| 72: upper housing outlet | 76: lower housing inlet |
| 77: lower housing outlet | |
| 80, 80a, 80b, 80(V), 80(H): blade | |

What is claimed is:

1. An air conditioner comprising:

a housing including a main fan suction port and a main fan discharge port, the main fan suction port connected to the main fan discharge port by a main air flow path;

a main fan provided in the main air flow path and configured to intake air from the main fan suction port and to discharge the air from the main fan discharge port, and including a rotation axis disposed in parallel with a longitudinal direction of the discharge port; and an auxiliary fan configured to intake the air at the main fan discharge port into an auxiliary air flow path of the air conditioner and discharge the air into the main air flow path at a point downstream of the main fan to regulate a direction of the air discharged from the main fan discharge port.

2. The air conditioner of claim 1, wherein an auxiliary fan suction port of the auxiliary air flow path is formed in parallel with the main fan discharge port.

3. The air conditioner of claim 1, wherein the auxiliary air flow path includes an auxiliary fan discharge air flow path configured to discharge the air from the auxiliary fan and an auxiliary fan suction air flow path configured to intake the air to the auxiliary fan.

4. The air conditioner of claim 3, wherein the auxiliary fan discharge air flow path is provided in a central portion of a longitudinal direction of the auxiliary air flow path, and the auxiliary fan suction air flow path is provided on both sides of the auxiliary fan discharge air flow path.

5. The air conditioner of claim 3, further comprising:

a fan case accommodating the auxiliary fan, wherein the auxiliary fan discharge air flow path is formed inside the fan case and the auxiliary fan suction air flow path is formed outside the fan case.

6. The air conditioner of claim 3, wherein a cross-sectional area of the auxiliary fan suction air flow path decreases as a distance of the auxiliary fan suction air flow path from the auxiliary fan increases.

7. The air conditioner of claim 3, wherein the housing comprises an auxiliary fan inlet configured to intake the air to the auxiliary fan suction air flow path, and an auxiliary fan outlet configured to discharge the air from the auxiliary fan discharge air flow path.

8. The air conditioner of claim 7, wherein a size of the auxiliary fan inlet is reduced as a distance of the auxiliary fan inlet from the auxiliary fan increases.

9. The air conditioner of claim 5, wherein the auxiliary fan comprises a plurality of auxiliary fans, and the auxiliary fan discharge air flow path comprises a plurality of auxiliary fan discharge air flow paths respectively corresponding to the plurality of auxiliary fans.

10. The air conditioner of claim 1, wherein the main fan is a cross-flow fan.

11. The air conditioner of claim 1, wherein the auxiliary fan is a centrifugal fan.

12. The air conditioner of claim 1, further comprising:

a heat exchanger disposed to be inclined with respect to the rotation axis of the main fan.

13. The air conditioner of claim 12, further comprising:

a drain pan configured to collect water condensed on the heat exchanger.

14. The air conditioner of claim 13, further comprising:

an auxiliary drain provided between the heat exchanger and the main fan suction port to guide the water condensed on the heat exchanger to an outside of the air conditioner.

15. An air conditioner comprising:

an upper housing configured to be embedded in or mounted on a ceiling and including a main air flow path and an auxiliary air flow path;

a lower housing configured to be coupled to the upper housing and including a suction port and a discharge port;

a main fan configured to intake air to the main air flow path through the suction port and discharge the air from the main air flow path through the discharge port; and an auxiliary fan configured to intake the air at the discharge port to the auxiliary air flow path to regulate a direction of the air discharged through the discharge port.

16. The air conditioner of claim 15, wherein the upper housing comprises a partition wall partitioning the main flow path from the auxiliary flow path.

17. The air conditioner of claim 15, wherein the upper housing comprises an auxiliary fan mounting portion to which the auxiliary fan is mounted.

18. An air conditioner comprising:

a housing including a suction port and a discharge port;

a main fan configured to intake air to an inside of the housing through the suction port and discharge the air from the inside of the housing through the discharge port;

an auxiliary fan configured to intake the air at the discharge port and discharge the air at a point downstream of the main fan to regulate a direction of the air discharged through the discharge port in a first direction; and a plurality of blades configured to regulate the direction of the air discharged through the discharge port in a second direction.

19. The air conditioner of claim 18, wherein the plurality of blades is rotatable between an open position and a closed position.

20. The air conditioner of claim 19, wherein the plurality of blades closes the discharge port when the plurality of blades is in the closed position.

* * * * *